US005924595A

United States Patent [19]

Crook

[11] Patent Number: 5,924,595

[45] Date of Patent: Jul. 20, 1999

[54] VENDING MACHINE ROTOR

[75] Inventor: Richard D. Crook, Cypress, Tex.

[73] Assignee: Great Spring Water of America, Inc., Greewich, Conn.

[21] Appl. No.: 08/882,915

[22] Filed: Jun. 26, 1997

[51] Int. Cl.[6] ..... G07F 11/16

[52] U.S. Cl. ..... 221/93; 221/95; 221/266

[58] Field of Search ..... 221/95, 133, 206, 221/266, 93, 123

[56] References Cited

U.S. PATENT DOCUMENTS

| | | | |
|---|---|---|---|
| 1,694,599 | 12/1928 | Lea . | |
| 1,729,886 | 10/1929 | Massie . | |
| 2,156,196 | 4/1939 | Romanoski | 312/48 |
| 2,459,715 | 1/1949 | Newman | 221/266 |
| 2,462,394 | 2/1949 | Heiman | 221/266 |
| 3,421,657 | 1/1969 | Larson | 221/13 |
| 3,424,345 | 1/1969 | Payne | 221/116 |
| 4,298,138 | 11/1981 | Oden | 221/115 |
| 4,509,658 | 4/1985 | Oden | 221/115 |
| 5,092,489 | 3/1992 | Pastor et al. | 221/266 |

FOREIGN PATENT DOCUMENTS

| | | | |
|---|---|---|---|
| 2616566 | 12/1988 | France | 221/133 |

*Primary Examiner*—H. Grant Skaggs
*Attorney, Agent, or Firm*—Fish & Neave; Robert R. Jackson; Matthew T. Byrne

[57] ABSTRACT

A vending machine rotor is provided which allows for the holding and subsequent dispensing of two or more bottles from a vending machine. The vending machine rotor provides a reservoir which comprises at least two bottle locations in which bottles may be loaded and then from which the bottles may be dispensed. While loaded in the rotor, cut-outs in the rotor enable the necks of at least two of the bottles to overlap by providing recesses in which the outer surfaces of at least two of the bottles may partially radiate outward from the axis of the vending machine rotor. Finally, a thickened portion of the rotor body may be provided to prevent bottles which exceed a maximum diameter from being used with the rotor of the present invention.

13 Claims, 5 Drawing Sheets

VENDING MACHINE ROTOR

BACKGROUND OF THE INVENTION

This invention relates to vending machine rotors. Vending machine rotors are widely used to hold and dispense products from vending machines. More particularly, this invention relates to vending machine rotors which are used to hold and dispense bottled products such as spring water from vending machines originally designed for the dispensing of canned beverages such as soft drinks, cold teas, and fruit drinks.

Generally speaking, vending machine rotors are substantially cylindrically shaped cradles which contain one or more compartments and which are positioned such that their axes lie substantially in a horizontal plane of a vending machine between columns of products and a dispensing chute. These rotors operate by rotating about their axes so that their compartments move from loading positions, where products are loaded from the columns of products, to dispensing positions, where products are dispensed into the dispensing chute. Usually, the loading positions of the vending machine rotors are at the point of their rotation where their compartments' openings are facing straight upward. In these positions, goods are usually dropped into the rotors' compartments from the columns of goods positioned directly above the rotors. The dispensing positions of the rotors are usually the position where their compartments' openings are facing straight downward. In these positions, goods are usually dropped out of the rotors' compartments into the dispensing chute from which a customer can retrieve the vended goods.

In the prior art, such vending machine rotors have been used for the holding and dispensing of a variety of canned goods and foodstuffs. For example, Lea U.S. Pat. No. 1,694,599 shows using a vending machine rotor to hold and dispense can shaped products, and Massie U.S. Pat. No. 1,729,886 shows using a vending machine rotor to hold and dispense fruit. Similarly, Romanoski U.S. Pat. No. 2,156,196, Larson U.S. Pat. No. 3,421,657, Payne U.S. Pat. No. 3,424,345, and Oden U.S. Pat. No. 4,298,138 also show vending machine rotors for holding and dispensing hard boiled eggs, produce, and canned goods.

Many widely used vending machines contain vending machine rotors which are each configured to hold and dispense three standard twelve ounce soft drink cans. These rotors are designed so that the soft drink cans are held in equal spacing along the length of the rotor's axis, and so that each can is dispensed with a progressive rotation of the rotor from one or more loading positions through each of three dispensing positions.

With the recent popularity of bottled water, there is a need for a vending machine rotor which allows 16.9 ounce water bottles to be dispensed in the vending machines that have been designed to operate with rotors used to dispense three standard twelve ounce soft drink cans. Furthermore, it is also desirable that the new rotors be designed so that they may only be used for the dispensing of 16.9 ounce water bottles to promote the continued availability of water bottles in these vending machines.

In view of the foregoing, it would be desirable to provide a vending machine rotor which allows for the dispensing of bottled products.

It would also be desirable to provide a vending machine rotor which allows for the dispensing of two 16.9 ounce bottles and which is substantially the same size as rotors used to dispense three standard twelve ounce soft drink cans.

It would be further desirable to provide a vending machine rotor which allows for the dispensing of bottled products and which restricts the bottles that may be dispensed using the rotor to bottles which do not exceed a predetermined size.

SUMMARY OF THE INVENTION

It is therefore an object of this invention to provide a vending machine rotor which allows for the dispensing of bottled products.

It is another object of this invention to provide a vending machine rotor which allows for the dispensing of two 16.9 ounce bottles and which is substantially the same size as rotors used to dispense three standard twelve ounce soft drink cans.

It is a further object of this invention to provide a vending machine rotor which allows for the dispensing of bottled products and which restricts the bottles that may be dispensed using the rotor to bottles which do not exceed a predetermined size.

These and other objects of the invention are accomplished in accordance with the principles of the invention by providing a vending machine rotor which allows two 16.9 ounce water bottles to be dispensed using a rotor which is substantially the same size as rotors used to dispense three standard twelve ounce soft drink cans. The rotor of the present invention is configured so that the two 16.9 ounce bottles are positioned substantially axially along the length of the rotor with the two necks of the bottles overlapping in length at approximately the center of the rotor. To facilitate the overlapping of the two bottles, two cut-outs are provided in the rotor which allow the bottles to partially extend radially outward from the axis of the rotor so that the two necks of the bottles are essentially side-by-side. To insure that only bottles of a given size are used with the rotor of the present invention, a thickened portion of the rotor wall may also be provided which restricts the size of the bottles dispensed using the rotor to bottles which do not exceed a predetermined size.

BRIEF DESCRIPTION OF THE DRAWINGS

Further features of the invention, its nature and various advantages will be more apparent from the accompanying drawings and the following detailed description of the preferred embodiments, taken in conjunction with the accompanying drawings, in which like reference characters refer to like parts throughout, and in which.

DETAILED DESCRIPTION OF THE PREFERRED EMBODIMENTS

Figure 1:
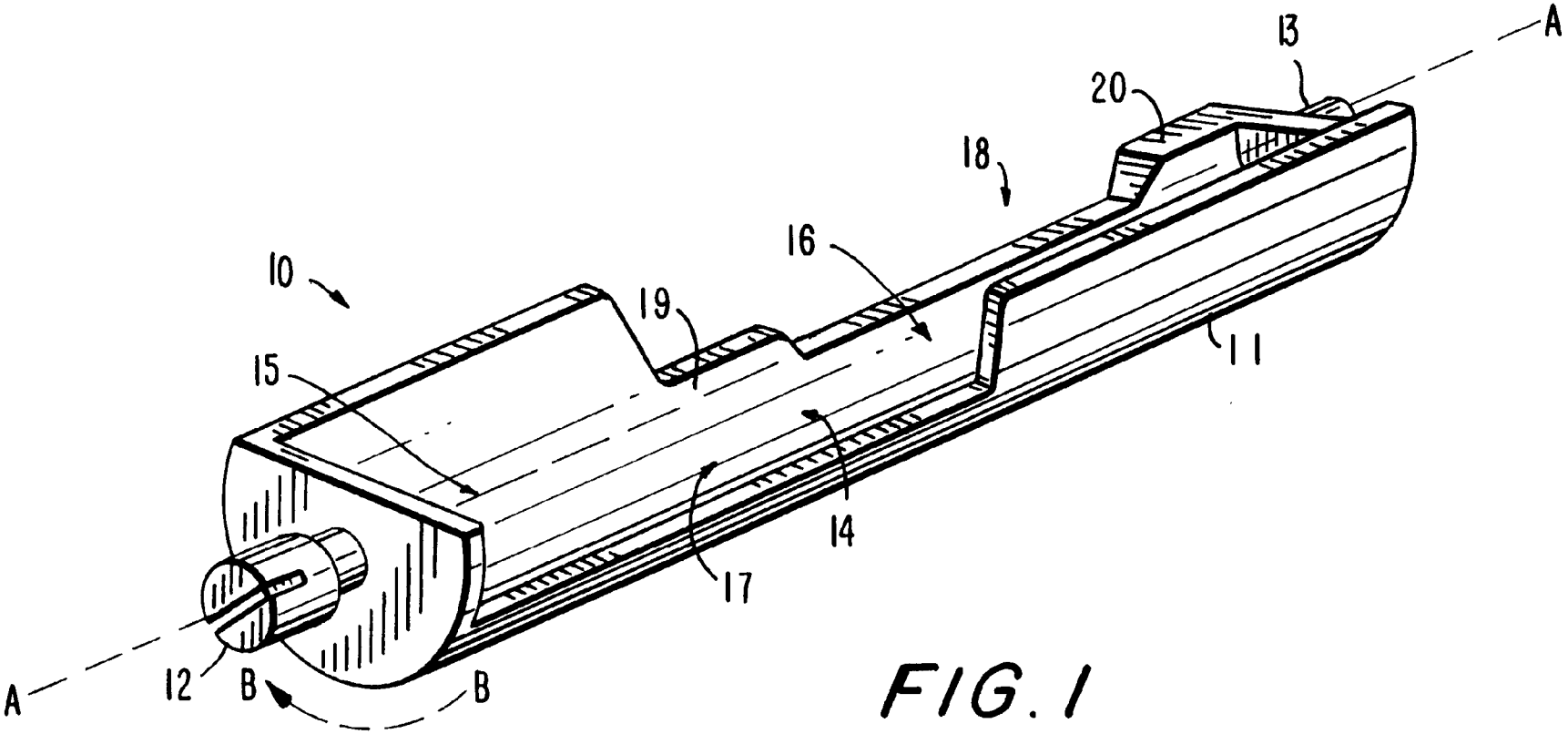
FIG. 1 is a perspective view of one embodiment of a vending machine rotor of the present invention.
Figure 2:
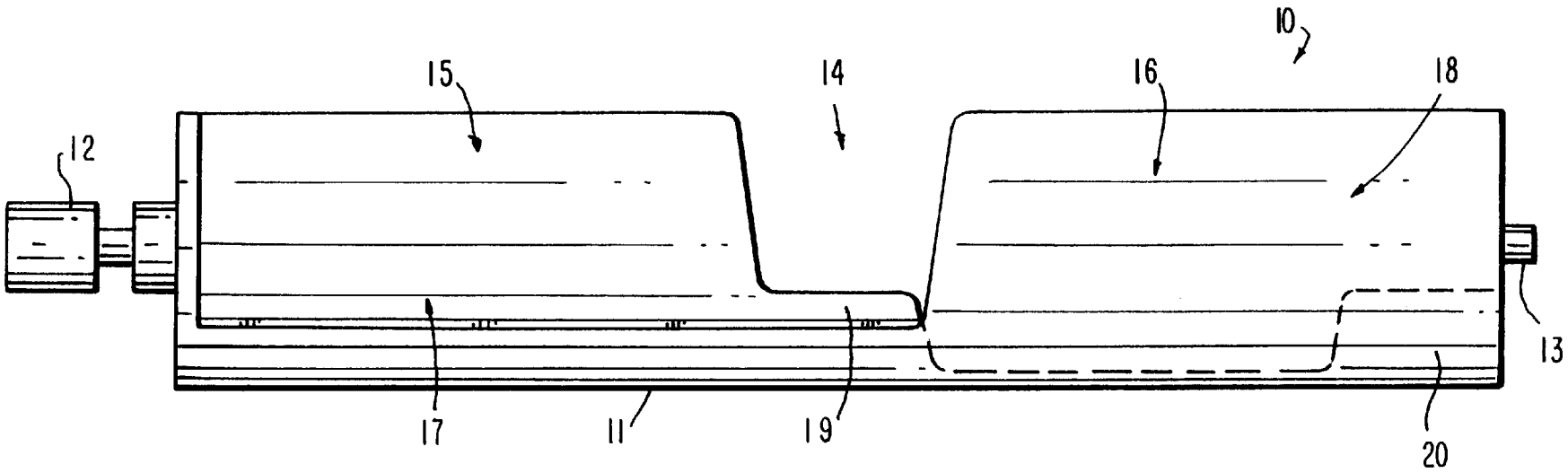
FIG. 2 is a side view of one embodiment of a vending machine rotor of the present invention.
Figure 3:
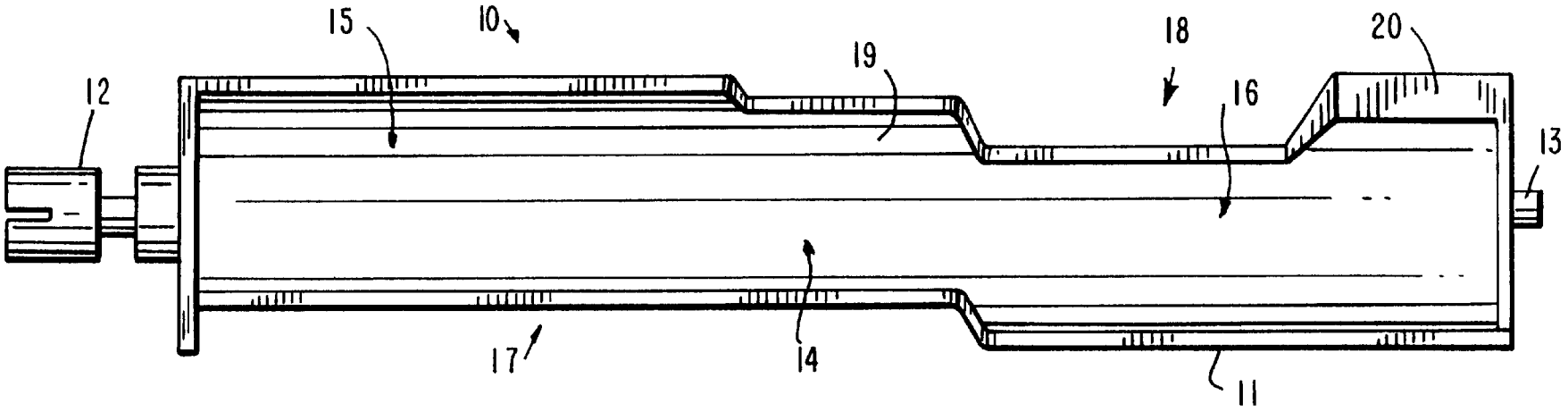
FIG. 3 is a top view of one embodiment of a vending machine rotor of the present invention.

Referring to FIGS. 1, 2, and 3, one embodiment of a vending machine rotor 10 of the present invention is shown in perspective, side, and top views, respectively. As illustrated, vending machine rotor 10 comprises a vending machine rotor body 11 which may be formed from any moldable material such as aluminum, steel, or plastic, for example. A front drive socket 12 and a rear pin 13 are provided on rotor body 11 to enable the rotor to be pivoted around the axis formed by drive socket 12 and pin 13 (as illustrated by line A—A in FIG. 1). By rotating rotor 10 around this axis in the direction of arrow B—B (FIG. 1), the vending machine rotor moves from its loading position (as shown) to its dispensing positions.

Figure 5:
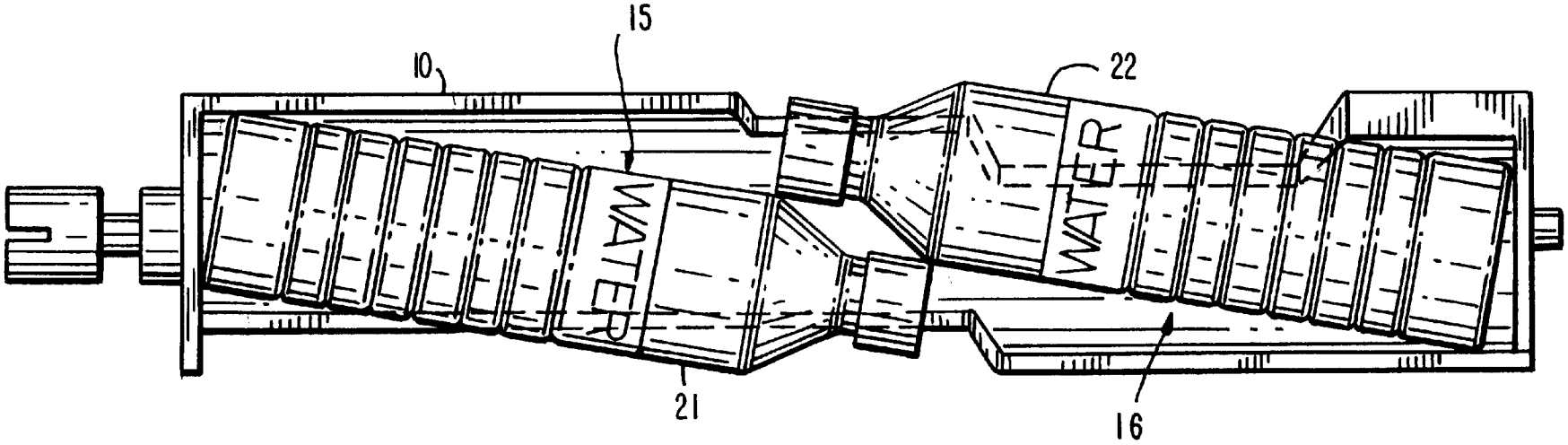
FIG. 5 is a top view of one embodiment of a vending machine rotor of the present invention, further showing the vending machine rotor containing two water bottles.

In a cavity of rotor body 11 of vending machine rotor 10 is a bottle reservoir 14. Bottle reservoir 14 comprises a front bottle location 15 and a rear bottle location 16 in which two bottles may be loaded. To enable bottles with lengths in excess of the half length of bottle reservoir 14 to be loaded into front bottle location 15 and rear bottle location 16, rotor body 11 comprises a front bottle cut-out 17 and a rear bottle cut-out 18 which allow the bottles to partially radiate outward from the axis of vending machine rotor 10 as shown in FIG. 5. In order to strengthen rotor body 11, rear bottle cut-out 18 leaves intact a support region 19. Support region 19 allows a bottle in rear bottle location 16 to radiate outward from the rotor's axis while simultaneously providing needed support to the middle of rotor body 11.

To insure that only bottles of a maximum size are used with the vending machine rotor of the present invention, a thickened portion 20 that limits the diameter of bottle reservoir 14 may also be provided in rotor body 11. By limiting the diameter of bottle reservoir 14, thickened portion 20 restricts the size of the bottles which may be placed in rear bottle location 16 to those which do not exceed a maximum diameter. Although thickened portion 20 as illustrated in FIGS. 1–3 is shown in the left-rear region of rear bottle location 16, a similar thickened portion could additionally or alternatively be implemented in other regions of rotor body 11 to provide the same size restricting effect. For example, a thickened portion of rotor body 11 could be implemented in the right-rear region of rear bottle location 16, in the inside-bottom of bottle reservoir 14, or in the left-front region of front bottle location 15.

Figure 4:
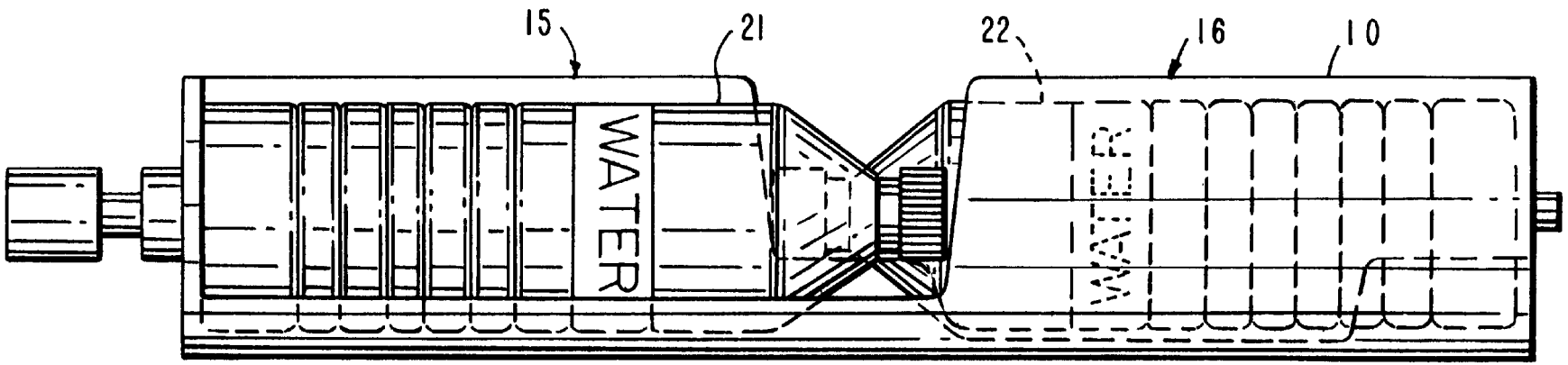
FIG. 4 is a side view of one embodiment of a vending machine rotor of the present invention, further showing the vending machine rotor containing two water bottles.

As shown in FIGS. 4 and 5, one embodiment of the vending machine rotor of the present invention is shown with a first bottle 21 loaded into front bottle location 15 and a second bottle 22 loaded into rear bottle location 16. As shown in these figures, the bottles lie substantially along the axis formed by front drive socket 12 and rear pin 13 (as illustrated by line A—A in FIG. 1). As can be seen from these figures, because the lengths of the bottles exceed the half length of the bottle reservoir 14 of vending machine rotor 10, the necks of bottles 21 and 22 overlap each other at approximately the middle of the rotor's length. To accommodate this overlap, the cut-outs 17 and 18 enable the necks of bottles 21 and 22 to be placed side-by-side at the center of rotor 10. In this way, two bottles, which would in combination exceed the length of a rotor of the prior art, may be loaded into and dispensed from the vending machine rotor of the present invention.

It will be understood that the foregoing is only illustrative of the principles of the invention and that various modifications can be made by those skilled in the art without departing from the scope and spirit of the invention, which is limited only by the claims that follow. For example, although 16.9 ounce water bottles are used to illustrate the dimensions of one embodiment of the vending machine rotor of the present invention, the vending machine rotor of the present invention could also be implemented to accommodate any size or type of bottle. As another example, the overall dimensions of the rotor of the present invention could be altered to allow for any number of bottle neck overlaps such as a single pair of bottles, two pairs of bottles, three pairs of bottles, etc. As still another example, space for one or more additional bottles which do not overlap with other bottles could also be allowed for in the vending machine rotor of the present invention. As yet another example, support region 19 could be removed from rotor body 11 in the instance that rotor body 11 is sufficiently strong without support region 19. As a further example, thickened portion 20 could be cut-out or left non-thickened in instances where a maximum bottle size is not a concern. As a still further example, drive socket 12 and/or rear pin 11 could be removed from rotor body 11 where other means suitable to support and rotate rotor body 11 are desirable. As a yet further example, rotor body 11 could be manufactured from any suitable material capable of maintaining the desired shape and sustaining the expected loads of a vending machine rotor of the present invention.

The invention claimed is:

1. A vending machine rotor for dispensing a first bottle and a second bottle from a vending machine, comprising:

a semicylindrical rotor body that has:

a first bottle location in which the first bottle can be loaded, a second bottle location in which the second bottle can be loaded, a leading edge that has a first cut-out through which one of the first bottle and the second bottle can pass when loaded in one of the first bottle location and the second bottle location, and a trailing edge that has a second cut-out through which one of the first bottle and the second bottle can pass when loaded in one of the first bottle location and the second bottle location.

2. The vending machine rotor of claim 1, wherein at least one of the leading edge and the trailing edge comprise a thickened region that limits the diameter of at least one of the first bottle and the second bottle that can be loaded in the vending machine rotor to a maximum diameter.

3. The vending machine rotor of claim 2, wherein the maximum diameter is about the diameter of a 16.9 ounce water bottle.

4. A vending machine comprising:

a vending machine rotor that has a cut-out in one of a leading edge and a trailing edge of the vending machine rotor;

a first bottle that is loaded into a first bottle location of the vending machine rotor so that a portion of the first bottle passes through the cut-out; and a second bottle that is loaded into a second bottle location of the vending machine rotor.

5. The vending machine of claim 4, wherein the vending machine rotor has another cut-out in another of the leading edge and the trailing edge of the vending machine rotor, and wherein the second bottle is loaded into the second bottle location of the vending machine rotor so that a portion of the second bottle passes through the another cut-out.

6. The vending machine of claim 4, wherein a neck of the first bottle overlaps a neck of the second bottle when loaded in the vending machine rotor.

7. The vending machine of claim 4, wherein at least one of the leading edge and the trailing edge of the vending machine rotor comprise a thickened region that limits the diameter of at least one of the first bottle and the second bottle that can be loaded in the vending machine rotor to a maximum diameter.

8. The vending machine of claim 7, wherein the maximum diameter is about the diameter of a 16.9 ounce water bottle.

9. A method of dispensing a first bottle and a second bottle from a vending machine, comprising:

loading the first bottle into a first bottle location of a vending machine rotor so that a portion of the first bottle passes through a cutout in one of a leading edge and a trailing edge of the vending machine rotor;

loading the second bottle into a second bottle location of the vending machine rotor;

rotating the vending machine rotor so that the first bottle drops from the vending machine rotor; and rotating the vending machine rotor so that the second bottle drops from the vending machine rotor.

10. The method of claim 9, wherein the loading of the second bottle into the second bottle location of the vending machine rotor comprises loading the second bottle into the second bottle location of the vending machine rotor so that the second bottle passes through another cut-out in another of the leading edge and the trailing edge of the vending machine rotor.

11. The method of claim 9, further comprising overlapping a neck of the first bottle with a neck of the second bottle.

12. The method of claim 9, further comprising limiting the diameter of at least one of the first bottle and the second bottle that can be loaded in the vending machine rotor to a maximum diameter using a thickened region in at least one of the leading edge and the trailing edge of the vending machine rotor.

13. The method of claim 12, wherein the maximum diameter is about the diameter of a 16.9 ounce water bottle.

* * * * *

UNITED STATES PATENT AND TRADEMARK OFFICE

CERTIFICATE OF CORRECTION

PATENT NO : 5,924,595

DATED : July 20, 1999

INVENTION(S) : VENDING MACHINE ROTOR

It is certified that error appears in the above-identified patent and that said Letters Patent are hereby corrected as shown below:

On the Title Page:

[73] Assignee: change "Water" to --Waters-;

Column 4, line 64, change "comprise" to --comprises--.

Signed and Sealed this

Tenth Day of April, 2001

*Attest:*

Nicholas P. Godici

NICHOLAS P. GODICI

*Attesting Officer*

*Acting Director of the United States Patent and Trademark Office*